US011440218B2

(12) United States Patent
Barone et al.

(10) Patent No.: US 11,440,218 B2
(45) Date of Patent: Sep. 13, 2022

(54) CEMENT MIXING TOOL

(71) Applicants: Onofrio N. Barone, San Jose, CA (US); Rita C. Barone, San Jose, CA (US)

(72) Inventors: Onofrio N. Barone, San Jose, CA (US); Rita C. Barone, San Jose, CA (US)

( * ) Notice: Subject to any disclaimer, the term of this patent is extended or adjusted under 35 U.S.C. 154(b) by 200 days.

(21) Appl. No.: 16/806,070

(22) Filed: Mar. 2, 2020

(65) Prior Publication Data

US 2021/0268691 A1 Sep. 2, 2021

(51) Int. Cl.

| | |
|---|---|
| ***B28C 5/12*** | (2006.01) |
| ***B01F 27/13*** | (2022.01) |
| ***B01F 33/501*** | (2022.01) |
| ***B01F 35/00*** | (2022.01) |
| ***B01F 35/32*** | (2022.01) |
| ***B01F 101/28*** | (2022.01) |

(52) U.S. Cl.

CPC ..... *B28C 5/1215* (2013.01); *B01F 27/13* (2022.01); *B01F 33/50115* (2022.01); *B01F 35/186* (2022.01); *B01F 35/3204* (2022.01); *B01F 2101/28* (2022.01)

(58) Field of Classification Search

CPC . B28C 5/1215; B28C 5/0893; B01F 7/00583; B01F 13/0028; B01F 15/00538; B01F 15/00967; B01F 2215/0047; B01F 7/001; B01F 7/00308; B01F 27/13; B01F 33/50115; B01F 35/186; B01F 35/3204; B01F 2101/28; B01F 27/071; B01F 27/11252

See application file for complete search history.

(56) References Cited

U.S. PATENT DOCUMENTS

| | | | | | |
|---|---|---|---|---|---|
| 2,973,188 | A * | 2/1961 | Howe | B01F 15/00538 | 416/81 |
| 3,185,451 | A * | 5/1965 | Snyder | B01F 15/00538 | 366/66 |
| 5,401,098 | A * | 3/1995 | Vadnais | B01F 13/002 | 172/42 |
| 5,772,318 | A * | 6/1998 | Vadnais | B28C 5/1215 | 366/64 |
| 6,000,836 | A * | 12/1999 | Nemazi | B28C 5/1215 | 366/129 |
| 9,561,546 | B1 * | 2/2017 | Walter | B01F 7/00641 | |
| 9,999,969 | B1 * | 6/2018 | Walter | B01F 7/00725 | |
| D852,233 | S * | 6/2019 | Barone | D15/28 | |
| 2021/0268691 | A1 * | 9/2021 | Barone | B01F 13/0028 | |

* cited by examiner

*Primary Examiner* — Charles Cooley

(74) *Attorney, Agent, or Firm* — Ivan E. Rozek; Savantek Patent Services

(57) ABSTRACT

A cement mixing tool with a gearbox transmission assembly, an electric drill tool, a pair of mixing blades, a drive shaft housing assembly, a handle assembly and a splash guard. The electric drill tool is attached to the drive shaft housing assembly. The gearbox transmission assembly is attached to the drive shaft housing assembly. The pair of mixing blades are attached to opposing shafts extending from the gearbox transmission assembly. The splash guard attached to the exterior the drive shaft housing assembly. The handle assembly is attached to the drive shaft housing assembly. The resulting tool can be used by a person to mix wet cement within a wheelbarrow or other similar open topped container.

3 Claims, 9 Drawing Sheets

CEMENT MIXING TOOL

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable mixing tools used mainly in the construction industry and more specifically to a portable electrically powered hand-held cement mixing tool.

Cement is a common building substance that is used to produce walls, sidewalks, curbs, floors and other structural components of a building, road or other structure found in everyday life. Cement needs to be mixed with water to form a slurry which is then poured into a form and left to harden for several days. Large batches of cement are often delivered by cement trucks to a location. The cement is then pumped out and into waiting forms. For smaller jobs, a professional cement worker may have access to a motorized cement mixing machine, such as the 2⅕ Cu Ft Electric Concrete Cement Mixer Mortar Mixing Stucco Seeds Portable Barrow Machine, available on Amazon, which can delivered to a job site.

For smaller jobs people may elect to pour cement in powdered form into an open topped container such as a wheelbarrow, and then pour water into the wheelbarrow and mix a batch of cement by using a hand shovel to fully intersperse the water with the powdered cement.

However, there is a deficiency in this type of mixing in that it requires significant physical exertion to fully mix the cement powder with the water. Additionally, the chance of not fully mixing the two ingredients may lead to less than desirable outcomes regarding the structural integrity of the poured cement.

BRIEF SUMMARY OF THE INVENTION

The primary object of the invention is to provide portable cement mixing tool that is designed to be used by an individual when mixing cement in a wheelbarrow or similar sized open topped container.

Another object of the invention is to provide a cement mixing tool that is light weight and powered by a portable electric drill.

Another object of the invention is to provide a cement mixing tool that has easily removable and replaceable mixing blades.

A further object of the invention is to provide a cement mixing tool that includes a protective shield that prevents mixed cement from flying back towards the user.

Yet another object of the invention is to provide a cement mixing tool that includes a grip handle that can be adjusted by the user according to his or her arm length.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a cement mixing tool comprising: a gearbox transmission assembly, an electric drill tool, a pair of mixing blades, a drive shaft housing assembly, a handle assembly, a splash guard, said electric drill tool removably attached to said drive shaft housing assembly, said gearbox transmission assembly attached to said drive shaft housing assembly, said pair of mixing blades removably attached to opposing offset shafts extending from said gearbox transmission assembly, said splash guard attached to the exterior said drive shaft housing assembly via standard means, said handle assembly including an adjustable angle handle and an attachment clamp that secures said handle to said drive shaft housing assembly, said drive shaft housing assembly including an outer sleeve, an inner shaft, a pair of bearings, a connecting nut and a drill attachment coupling, said pair of bearings supporting said inner shaft within said outer sleeve, said inner shaft terminating at one end in a small worm gear and at the other end in a threaded portion, said gearbox transmission assembly including a large worm gear that engages the said small worm gear of said drive shaft housing assembly, said threaded portion of said inner shaft threadably attached to said connecting nut, the opposite side of said connecting nut threadably attached to a threaded shaft extending from the chuck of said electric drill tool, and said drill attachment coupling attached at one end to said outer sleeve and at the opposite the front portion of said electric drill tool via standard means.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE DRAWINGS AND PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
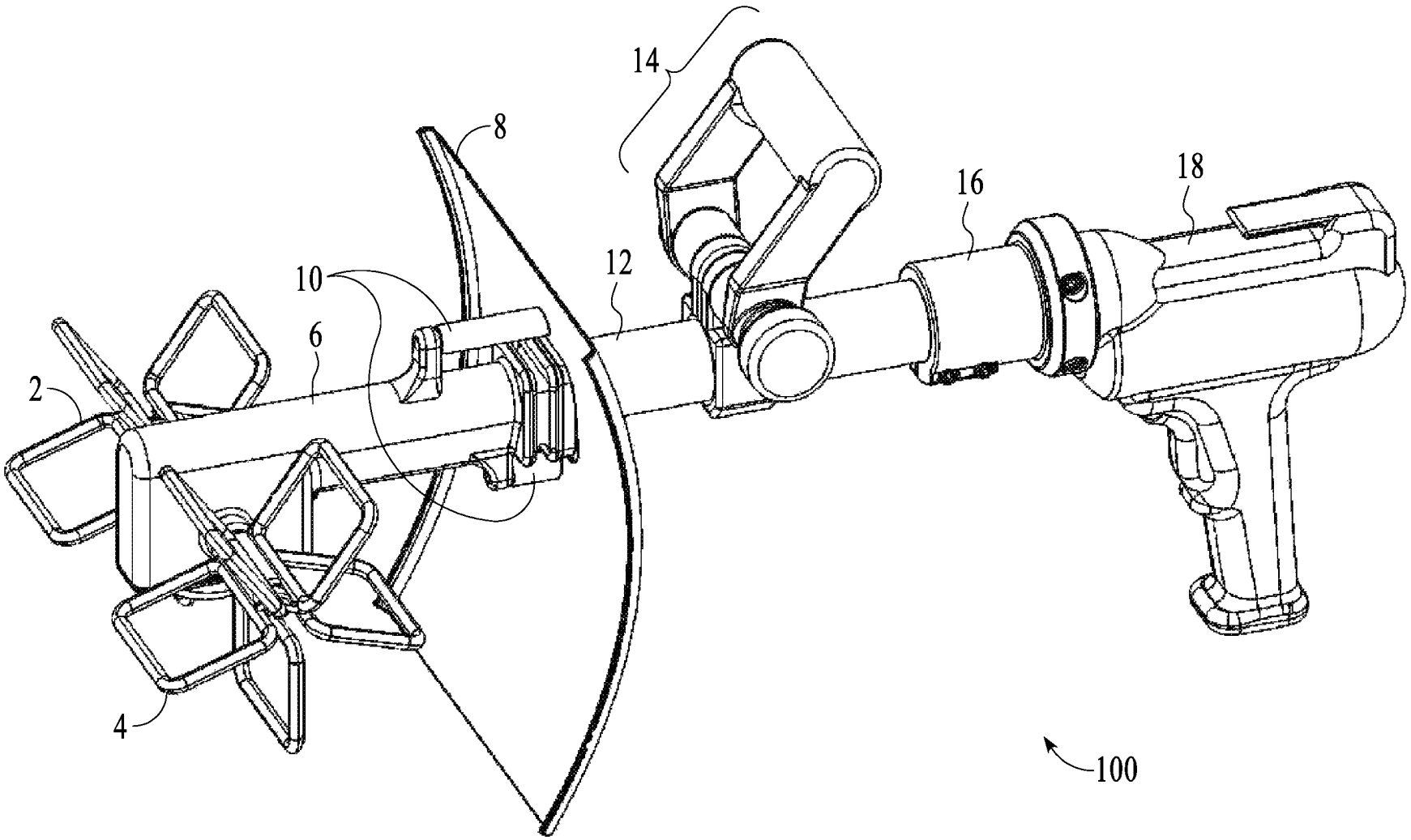
FIG. 1 is a perspective view of the invention.

Referring now to FIG. 1 we see perspective view of the invention 100. A standard electric drill 18 such as a Dewalt® Model DWD115⅜-inch 8-amp USR is used to power the portable cement mixing tool of the present invention 100. A connecting collar 16 attaches the drill 18 to a drive shaft housing assembly 12 which in turn connects to a gearbox transmission assembly 6, similar to the gearbox used in the Mantis™ Model 7260-00-03 product. The gearbox assembly 6 includes offset opposing shafts 42, 43, shown in FIG. 8, that releasably attach to mixing blades 2, 4. A splash guard 8 is held onto drive shaft housing assembly 12 via attachment bolts 10 and prevents wet cement from being flung outward toward the user during the cement mixing process. A handle assembly 14 allows the user to hold the tool 100 with one hand and activate the trigger of the electric drill 18 with the other hand. The tool 100 is designed to be used in conjunction with a wheelbarrow or other open topped container which holds a combination of powdered cement and water. The mixing blades 2, 4 engage the cement and water and help homogenize them together into a slurry that is ready to pour into a form which dictates the shape and size of the finished hardened cement. The length of the tool 100 is approximately two feet five inches. The tool's weight is approximately twenty-five pounds.

Figure 2:
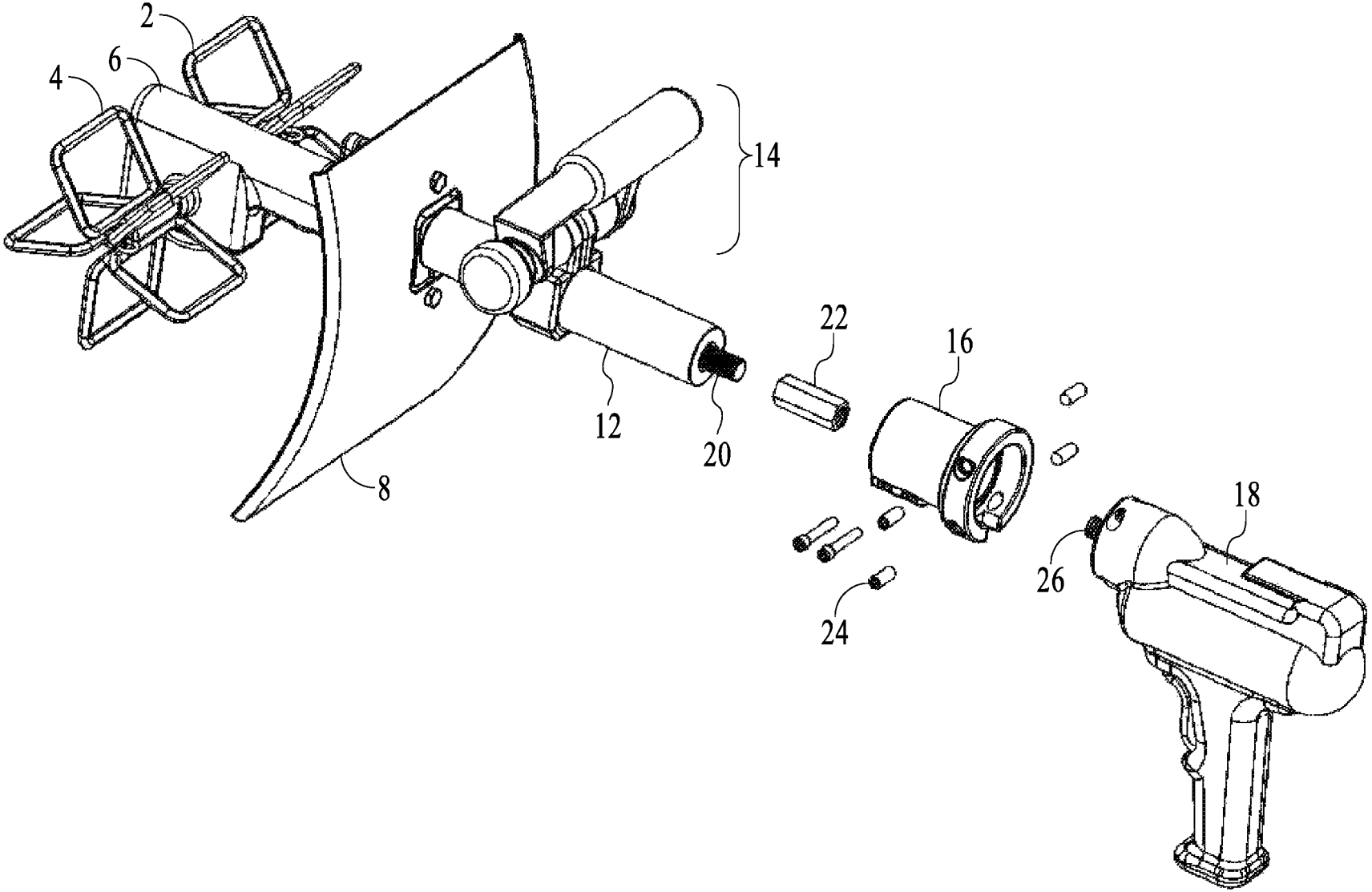
FIG. 2 is an exploded view of the invention.

FIG. 2 is an exploded view of the invention 100. This view shows an internal shaft 20 that is threaded on one end and has a small worm gear 54 on the opposite end as shown in the section view in FIG. 9 which in turn engages a large worm gear 46 which is directly attached to the opposing shafts 42, 43. The threaded portion of shaft 20 engages a coupling nut 22 which in turn engages a threaded shaft 26 attached to the chuck of drill member 18. Attachment screws 24 or other standard attachment means secure the collar 16 to the drill 18.

Figure 3:
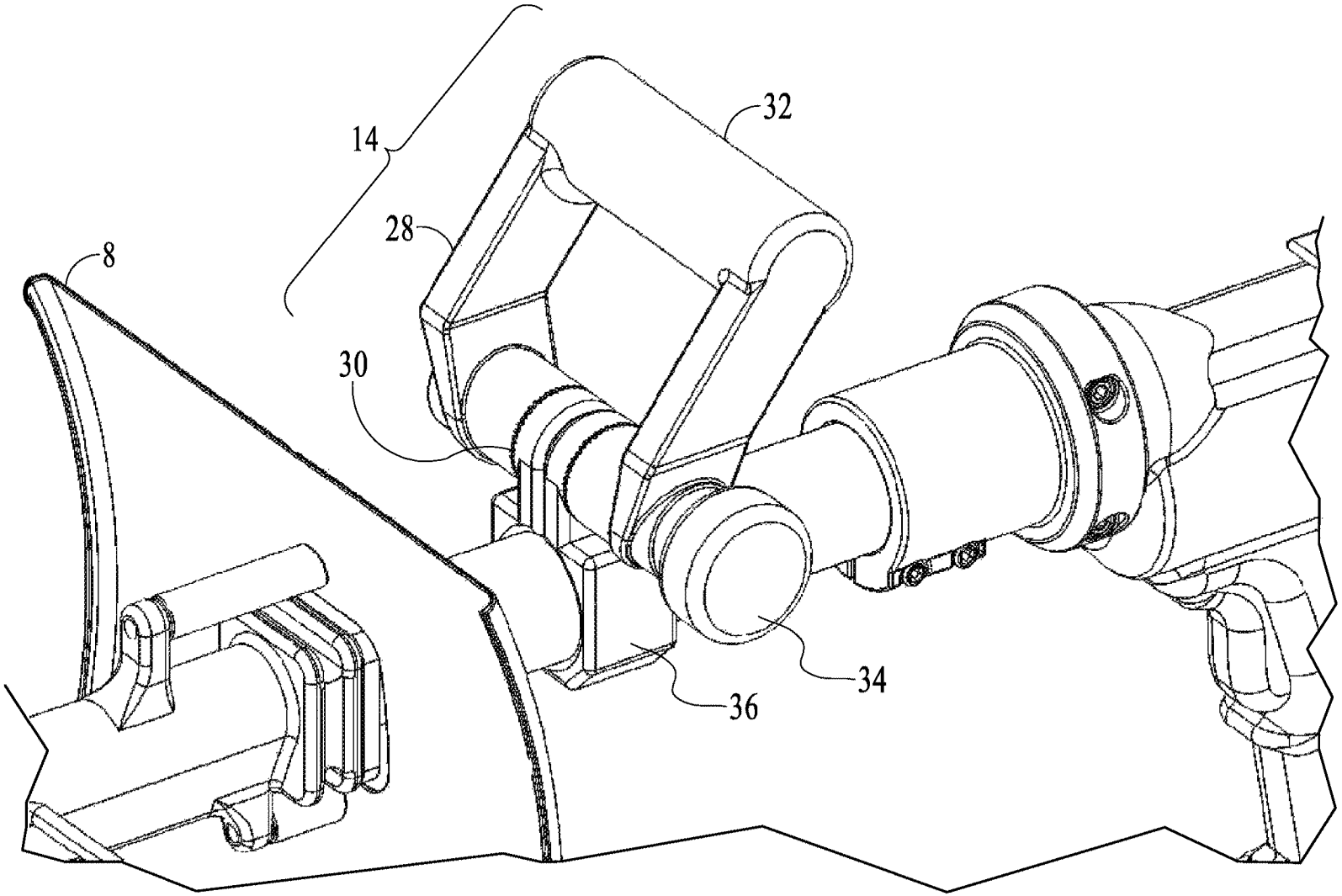
FIG. 3 is a partial perspective view showing the handle in the raised position.
Figure 4:
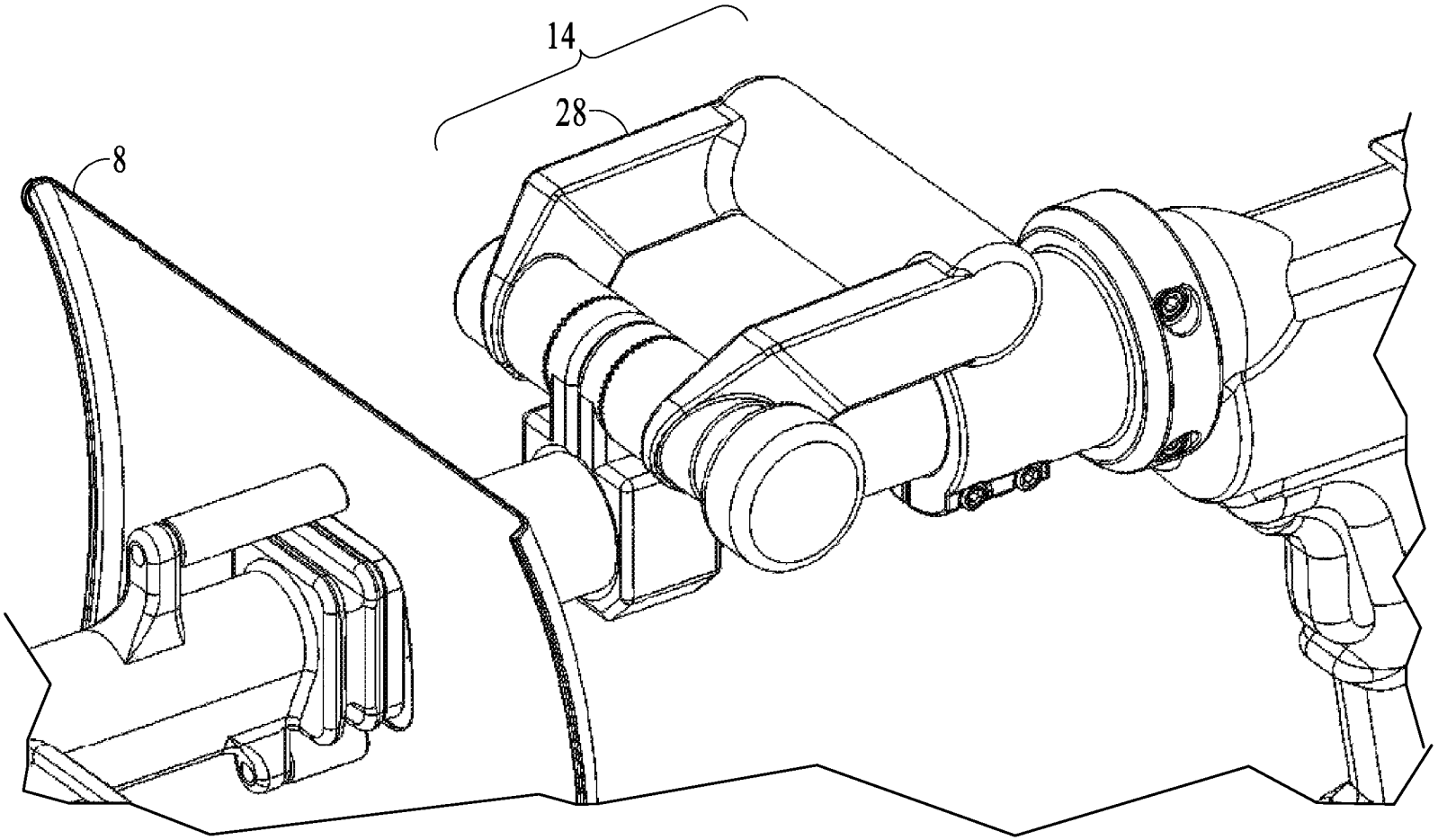
FIG. 4 is a partial perspective view showing the handle in the lowered position.

FIG. 3 is a partial perspective view of showing the handle assembly 14 which includes side handle supports 28, handle grip 32, locking washers 30, locking knob 34 and handle attachment collar 36. The user can adjust the angle of the handle grip 32 by loosening knob 34 which disengages the locking washers 30 allowing the grip 32 to rotate as shown in the folded down position in FIG. 4. The handle 32 includes a resilient gripping surface reducing the chance of hand slip and also reducing hand and finger fatigue.

Figure 5:
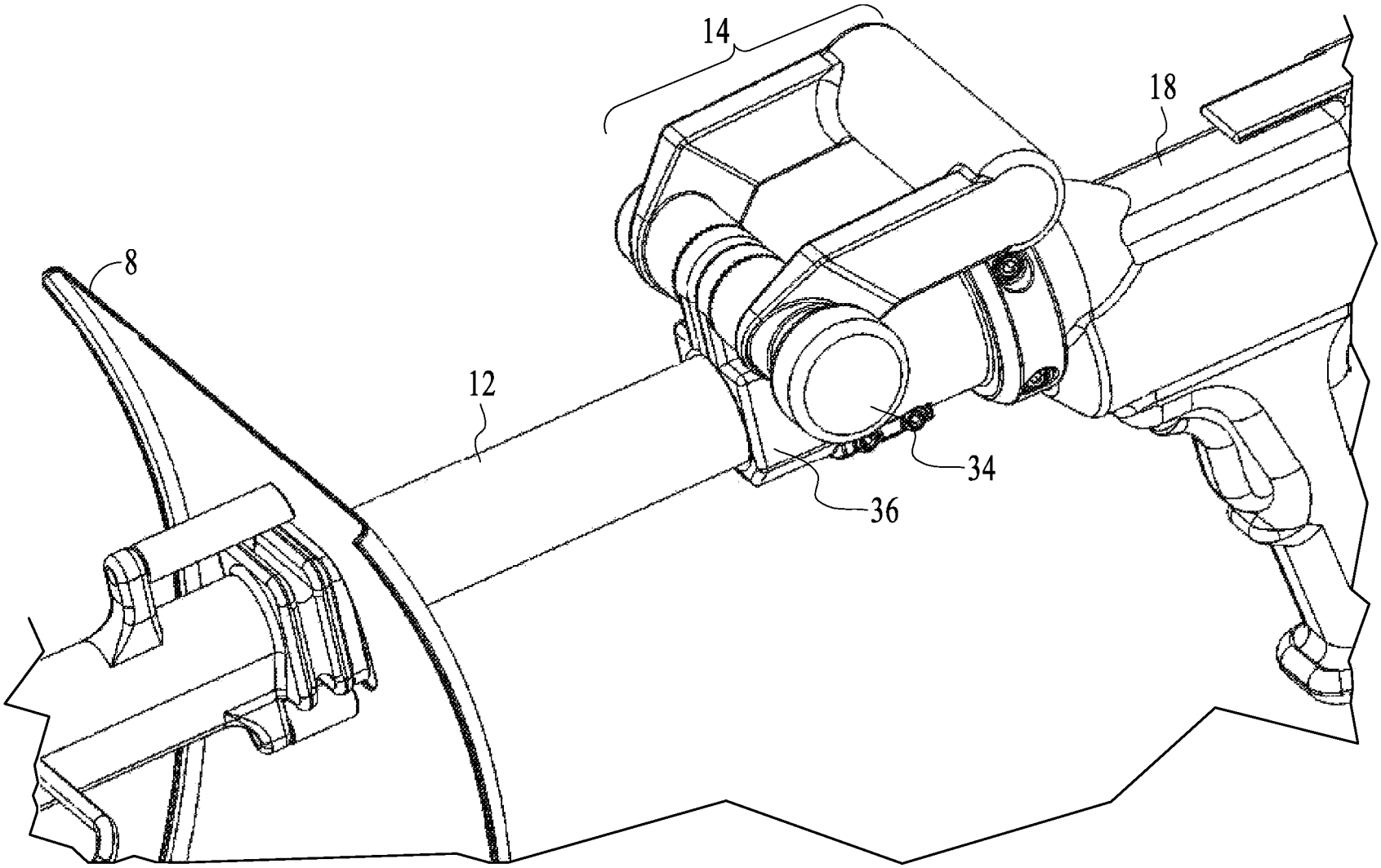
FIG. 5 is a partial perspective view showing the handle slide towards the electric drill.

FIG. 5 is a partial section view showing the handle assembly 14 slid toward the drill 18 for people with shorter arms.

Figure 6:
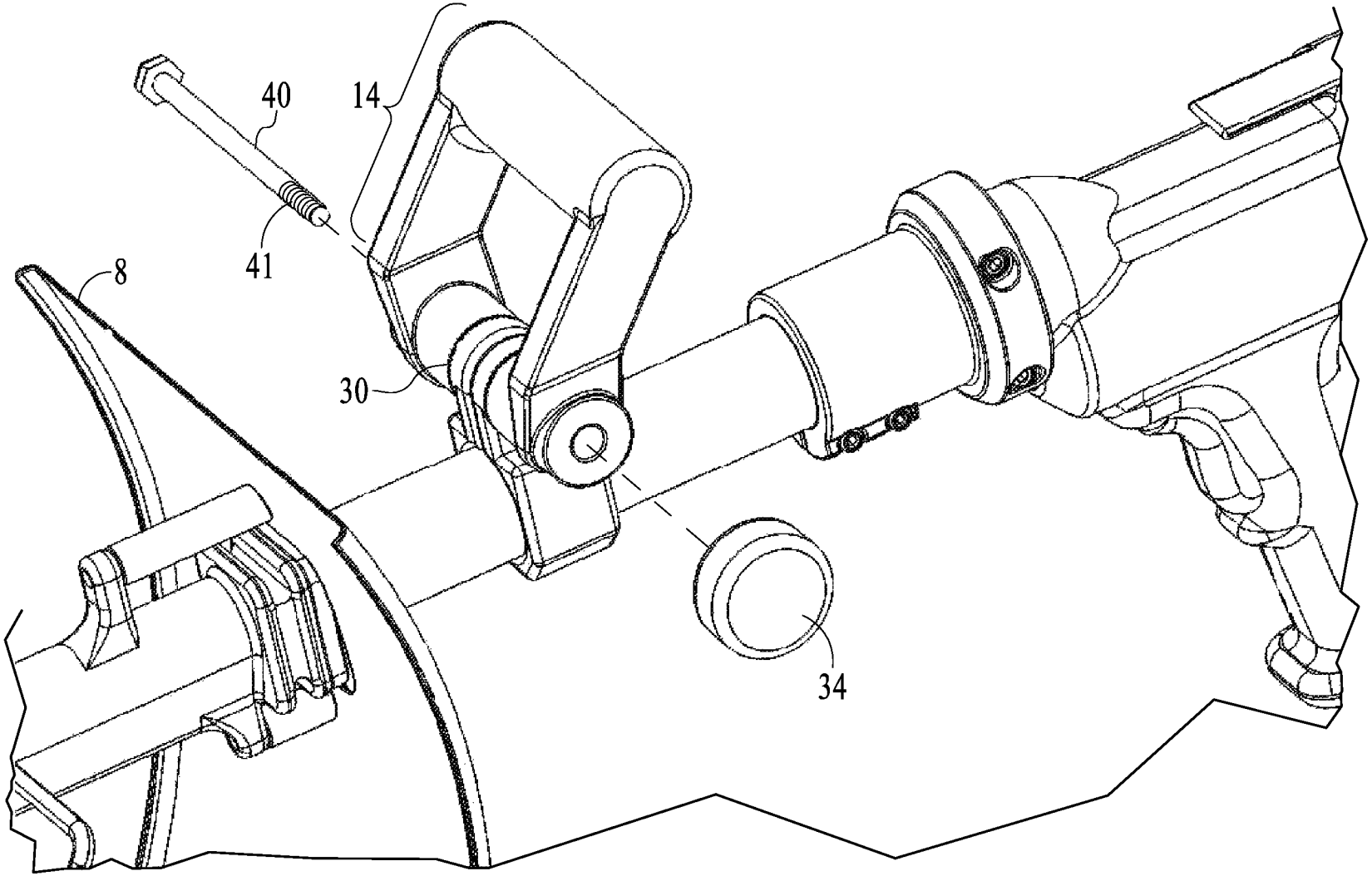
FIG. 6 is an exploded view of the handle assembly.

FIG. 6 is an exploded view of the handle assembly showing shaft 40 removed from the assembly 14. The threads 41 on the end of shaft 40 engage with mating female threads within knob 34 allowing the entire assembly to lock in place.

Figure 7:
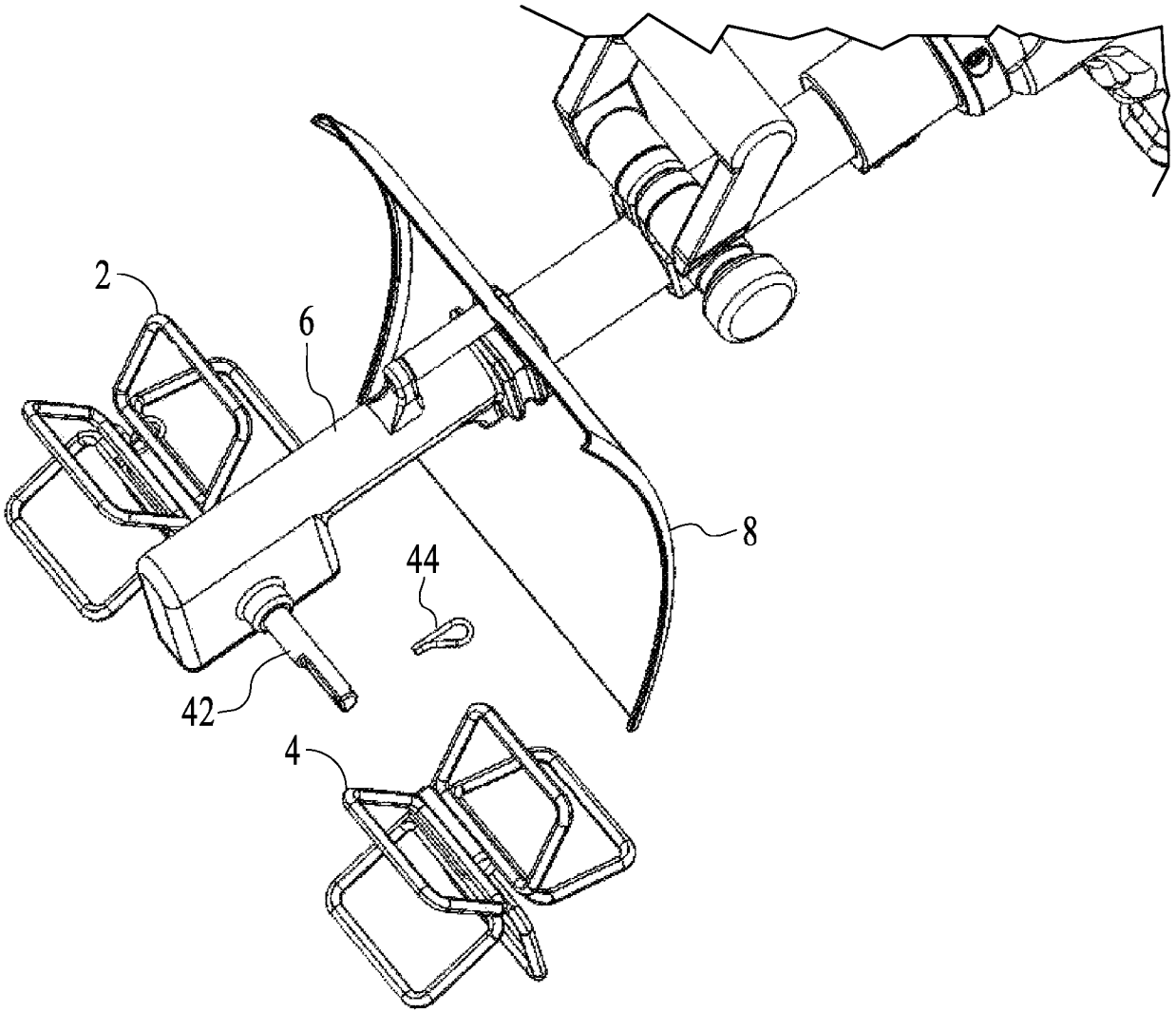
FIG. 7 is a partial perspective view showing one mixing blade removed from the gear housing.

FIG. 7 is a partial perspective view showing one mixing blade 4 removed from offset shaft 42 of gear box 6. Cotter pin 44 holds the blade 4 in place. However other standard retaining methods may be used. The user can remove the cotter pin by hand to remove the mixing blade 4. The mixing blades 2, 4 have five wings each. Each wing is comprised of bent metal rods forming a rectangular frame. The open construction of the wings allows for the optimal mixing action when comingling the cement powder with water.

Figure 8:
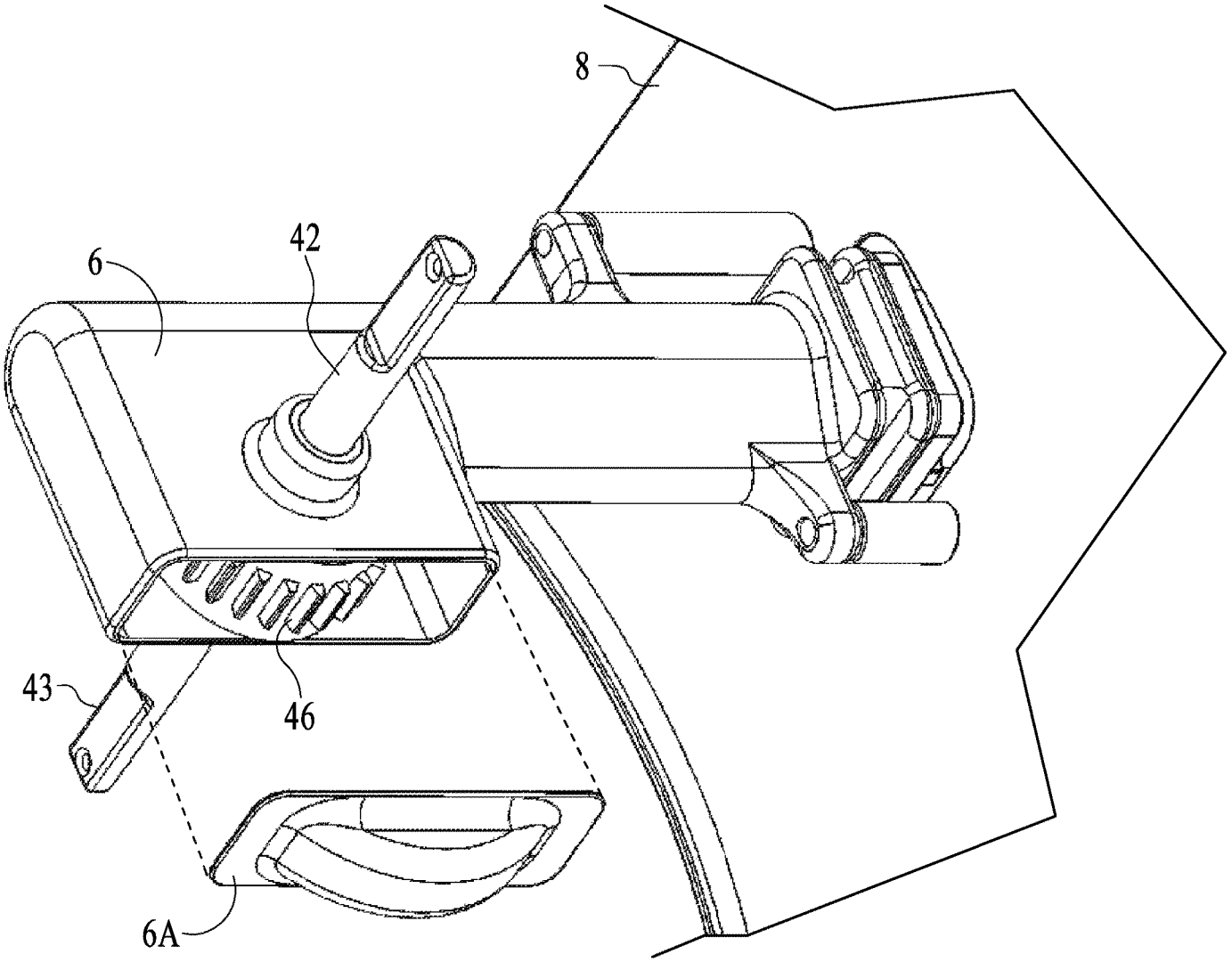
FIG. 8 is a perspective view of the gear housing assembly with an end plate removed.

FIG. 8 is a partial perspective view of the gearbox transmission assembly 6 with the cover 6A removed to show large worm gear 46. This view also clearly shows opposing shafts 42, 43 which are fixedly attached to the center of the large worm gear 46. The internal portion of the housing 6 is usually filled with grease for ideal lubrication of both worm gears 46, 54.

Figure 9:
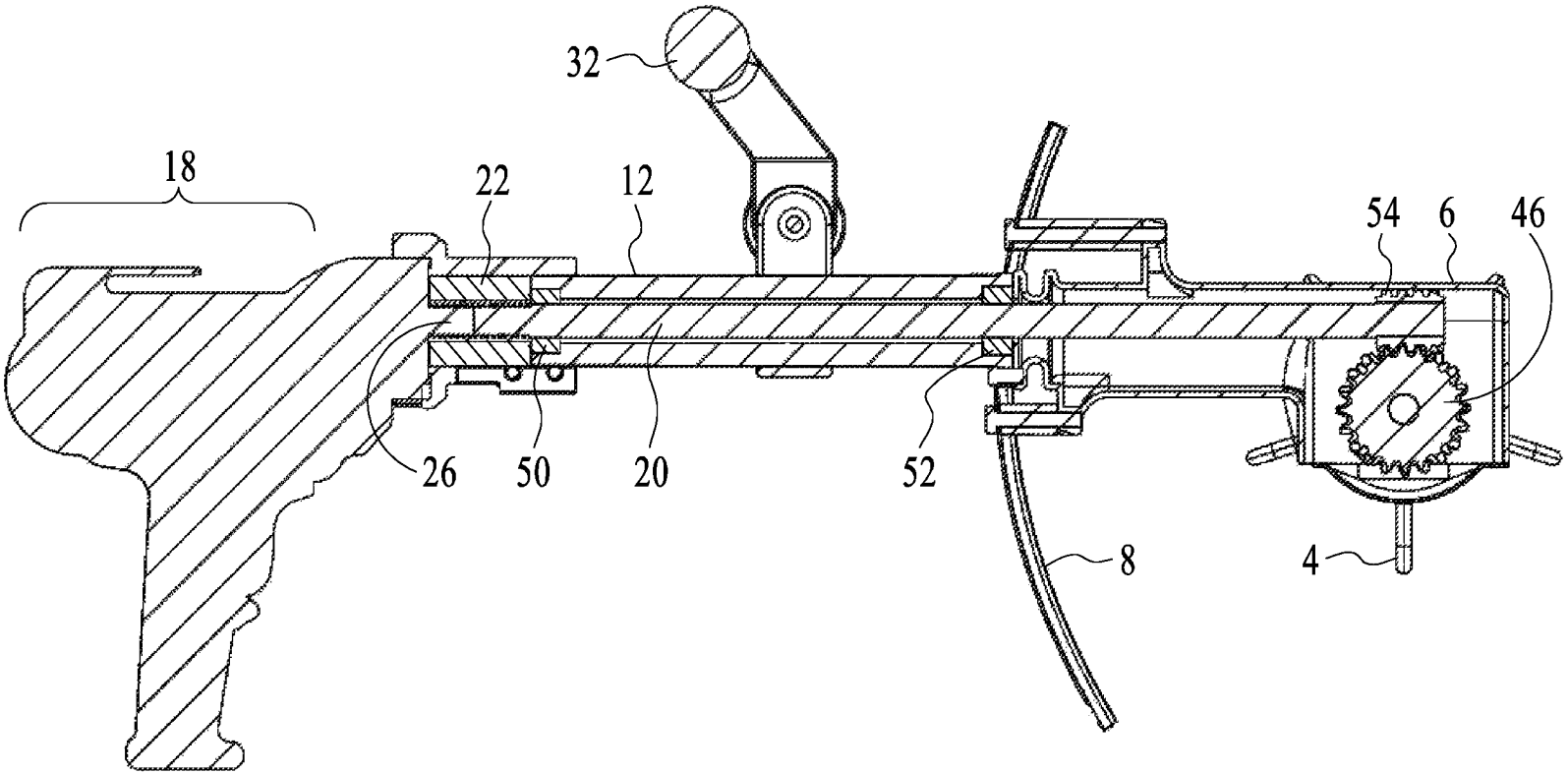
FIG. 9 is a side section view of the invention.

FIG. 9 is a side section view of the invention 100. Internal ball bearings 50, 52 can be clearly seen supporting internal shaft member 20. Coupling nut 22 can be seen attaching the threaded end of shaft 20 to the output shaft 26 of drill member 18. Small worm gear 54 is shown engaging large worm gear 46. The drill shaft 26 can be screwed into the coupling nut 22 by activating the drill and having it turn in a clockwise direction. The drill 18 and shaft 26 can be removed from the coupling 22 by having the drill turn counter-clockwise.

The entire invention 100 is relatively light weight and easy to use. The invention allows a user to mix cement in less time and with less physical exertion. The tool can easily be transported in the back of a pick-up truck or car trunk. Many professionals mix small batches of cement from time to time, including masons, plumbers, electricians, carpenters, landscapers and maintenance workers as well as normal home owners. The tool 100 can be used indoors or outdoors. The removable blades 2, 4 allow the ability to clean the tool 100 quickly and easily.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A cement mixing tool comprising:

a gearbox transmission assembly;

an electric drill tool;

a pair of mixing blades;

a drive shaft housing assembly;

a handle assembly;

a splash guard;

said electric drill tool removably attached to said drive shaft housing assembly;

said gearbox transmission assembly attached to said drive shaft housing assembly;

said pair of mixing blades removably attached to opposing offset shafts extending from said gearbox transmission assembly;

said splash guard attached to the exterior said drive shaft housing assembly via attachment bolts;

said handle assembly including an adjustable angle handle and an attachment clamp that secures said handle to said drive shaft housing assembly;

said drive shaft housing assembly including an outer sleeve, an inner shaft, a pair of bearings, a connecting nut and a drill connecting collar;

said pair of bearings supporting said inner shaft within said outer sleeve;

said inner shaft terminating on one end in a small worm gear and at the other end in a threaded portion;

said gearbox transmission assembly including a large worm gear that engages the said small worm gear of said drive shaft housing assembly;

said threaded portion of said inner shaft threadably attached to said connecting nut;

the opposite side of said connecting nut threadably attached to a threaded shaft extending from a chuck of said electric drill tool; and said drill connecting collar attached at one end to said outer sleeve and at the opposite end to the front portion of said electric drill tool.

2. A cement mixing tool as claimed in claim 1 wherein said handle assembly is slidably adjustable along the length of said outer sleeve.

3. A cement mixing tool as claimed in claim 1 wherein each of the mixing blades comprises five wings; and said five wings each having an open frame construction.

* * * * *